US005900893A

United States Patent [19]

Joly et al.

[11] Patent Number: 5,900,893

[45] Date of Patent: May 4, 1999

[54] DIRECT ELECTROSTATIC PRINTING DEVICE WHEREIN THE SPEEDS OF A MAGNETIC BRUSH AND A RECEIVING SUBSTRATE ARE RELATED TO EACH OTHER

[75] Inventors: Ludo Joly, Hove; Dirk Broddin, Edegem; Guido Desie, Herent, all of Belgium

[73] Assignee: Agfa-Gevaert, Mortsel, Belgium

[21] Appl. No.: 08/634,963

[22] Filed: Apr. 19, 1996

[30] Foreign Application Priority Data

Apr. 25, 1995 [EP] European Pat. Off. ..... 95201048
May 16, 1995 [EP] European Pat. Off. ..... 95201269

[51] Int. Cl.[6] ..... B41J 2/06

[52] U.S. Cl. ..... 347/55

[58] Field of Search ..... 347/55, 141, 151, 347/158; 399/285, 284

[56] References Cited

U.S. PATENT DOCUMENTS

| | | | |
|---|---|---|---|
| 3,679,414 | 7/1972 | Mukherjee | 96/67 |
| 3,779,166 | 12/1973 | Pressman et al. | 101/426 |
| 4,491,855 | 1/1985 | Fujii et al. | 347/55 |
| 4,537,491 | 8/1985 | Komada et al. | 399/236 |
| 4,544,935 | 10/1985 | Sakai | 347/151 |
| 4,743,926 | 5/1988 | Schmidlin et al. | 347/55 |
| 5,040,004 | 8/1991 | Schmidlin et al. | 347/55 |
| 5,110,705 | 5/1992 | Hosoya et al. | 399/285 X |
| 5,204,696 | 4/1993 | Schmidlin et al. | 347/55 |
| 5,214,451 | 5/1993 | Schmidlin et al. | 347/55 |
| 5,298,358 | 3/1994 | Rubin et al. | 430/126 |
| 5,416,565 | 5/1995 | Noda | 399/285 X |

FOREIGN PATENT DOCUMENTS

| | | | |
|---|---|---|---|
| 653686A1 | 10/1994 | European Pat. Off. . | |
| 60-263962 | 12/1985 | Japan | B41J 2/06 |
| WOA9426527 | 11/1994 | WIPO | B41J 2/06 |

*Primary Examiner*—Benjamin R. Fuller
*Assistant Examiner*—C. Dickens
*Attorney, Agent, or Firm*—Baker & Botts, L.L.P.

[57] ABSTRACT

There is provided a device for direct electrostatic printing comprising a back electrode (105), a printhead structure (106), an array of printing apertures (107) in said printhead structure (106) through which a particle flow can be electrically modulated by a control electrode (106*a*), an image receiving substrate (109) travelling between said back electrode (105) and said printhead structure (106) in the direction of arrow A and toner delivery means (101), comprising a charged toner conveyer (103), the reference surface of said charged toner conveyer being placed at a distance B (in mm) from the front of said printhead structure (106), and a magnetic brush to provide charged toner on to the CTC, wherein the linear surface speed of the magnetic brush LSM has a specified minimal ratio versus the travelling speed LSS of the image receiving substrate, such that LSM/LSS≧0.5. In a preferred embodiment the surface speed of the CTC LSC has also a specified minimal ratio versus the travelling speed LSS of the image receiving substrate, such that LSC/LSS≧0.5. In a further preferred embodiment the surface speed of the magnetic brush LSM has a also a specified minimal ratio versus the linear surface speed LSC of the CTC, such that LSM/LSC≧0.5. More over the radius of the CTC is chosen as a function of the extension of the array of printing apertures present in the printhead structure.

13 Claims, 4 Drawing Sheets

DIRECT ELECTROSTATIC PRINTING DEVICE WHEREIN THE SPEEDS OF A MAGNETIC BRUSH AND A RECEIVING SUBSTRATE ARE RELATED TO EACH OTHER

DESCRIPTION

1. Field of the invention

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure.

2. Background of the Invention

In DEP (Direct Electrostatic Printing) the toner or developing material is deposited directly in an imagewise way on a receiving substrate, the latter not bearing any imagewise latent electrostatic image. The substrate can be an intermediate endless flexible belt (e.g. aluminium, polyimide etc.). In that case the imagewise deposited toner must be transferred onto another final substrate. Preferentially the toner is deposited directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible.

Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures. Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

A DEP device is well suited to print half-tone images. The densities variations present in a half-tone image can be obtained by modulation of the voltage applied to the individual control electrodes. In most DEP systems large apertures are used for obtaining a high degree of density resolution (i.e. for producing an image comprising a high amount of differentiated density levels).

For text quality, however, a high spatial resolution is required. This means that small apertures must have to be made through said plastic material, said control electrodes and said shield electrode.

If small apertures are used in the printhead structure in order to obtain a high spatial resolution, then the overall printing density is rather low. This means that either the printing speed too is rather low, or that multiple overlapping rows of addressable apertures have to be implemented, yielding a complex printhead structure and printing device.

By using apertures with a large aperture diameter, it is also necessary to provide multiple rows of apertures in order to obtain an homogeneous grey density for the whole image.

Printhead structures with enhanced density and/or spatial control have been described in the literature. In U.S. Pat. No. 4,860,036 e.g. a printhead structure has been described consisting of at least 3 (preferentially 4 or more) rows of apertures which makes it possible to print images with a smooth page-wide density scale without white-banding. The main drawback of this kind of printhead structure deals with the toner particle application module, which has to be able to provide charged toner particles in the vicinity of all printing apertures with a nearly equal flux. The problem of equal toner flux has been addressed in several ways (see e.g. U.S. Pat. No. 5,040,004, U.S. Pat. No. 5,214,451, U.S. Pat. No. 5,136,311, EP-A 731 394.

The printing speed achievable with DEP devices does not only depend on the possibility of using a printhead structure with multiple rows of printing apertures, nor does the printing quality only depend on providing charged toner particles in the vicinity of all printing apertures with a nearly equal flux, but both printing speed and printing quality depend also on the amount of charged toner particles that is presented per unity of time in the vicinity of the printing apertures.

There is thus a need for a DEP device wherein it is possible to provide in a simple and reliable way a large amount of toner particles in the vicinity of the printing apertures.

OBJECTS AND SUMMARY OF THE INVENTION

It is an object of the invention to provide an improved Direct Electrostatic Printing (DEP) device, printing with high maximum density and high spatial resolution at a high printing speed.

It is a further object of the invention to provide a DEP device combining high spatial resolution, high density resolution and high maximum density with good long term stability and reliability.

It is still a further object of the invention to provide a printhead structure for a DEP device, wherein said printhead structure combines a compact design with good long term stability and reliability.

It is another object of the invention to provide a charged toner application module which combines a compact design with high printing speed and good long term stability.

Further objects and advantages of the invention will become clear from the description hereinafter.

The above objects are realized by providing a DEP device that comprises:

(i) a back electrode (105), (ii) a printhead structure (106), (iii) an array of printing apertures (107) in said printhead structure (106) through which a particle flow can be electrically modulated by a control electrode **(106*a*) and having an extension C (in mm) (107) in the direction of the movement of a receiving substrate (109), (iv) delivery means for charged toner particles (101), comprising a charged toner conveyer (103), the reference surface of said charged toner conveyer being placed at a distance B (in mm) from the front of said printhead structure (106), facing said charged toner conveyer, characterised in that (i) said charged toner conveyer (CTC) passes in the vicinity of said printhead structure at a linear surface speed LSC in mm/s, (ii) said charged toner particles are applied to said CTC from a by a magnetic brush with a sleeve rotating at a linear surface speed LSM in mm/s (iii) said image receiving substrate travels at a linear speed LSS in mm/s between said back electrode (105) and said printhead structure (106)** in the direction of arrow A (iv) said surface speed of said sleeve (LSM) and said speed of image receiving substrate (LSS) relate to each other in a ratio LSM/LSS≧0.50.

In a preferred embodiment not only the ratio LSM/LSS is larger than 0.5 but also the ratio of said surface speed of said CTC (LSC) to said speed of image receiving substrate (LSS) is equal to or larger than 0.50.

In a further preferred embodiment LSM/LSS≧0.5 and LSC/LSS≧0.5 and the ratio of said surface speed of said sleeve LSM to said surface speed of said CTC (LSC) is equal to or larger than 0.50.

DEFINITIONS

Throughout this disclosure following definitions are used:

"charged-toner conveyer (CTC)" is a conveyer for charged toner with a cylindrical shape, rotated in one direction, said charged toner being applied to it by means of a magnetic brush or a non-magnetic mono-component toner charging member.

"curvature of the CTC" is the curvature of the surface of said cylindrical CTC in the development zone and is expressed as the radius of said cylinder.

"reference surface of the CTC" is the surface of the CTC when NO toner is present on said CTC.

Figure 2:
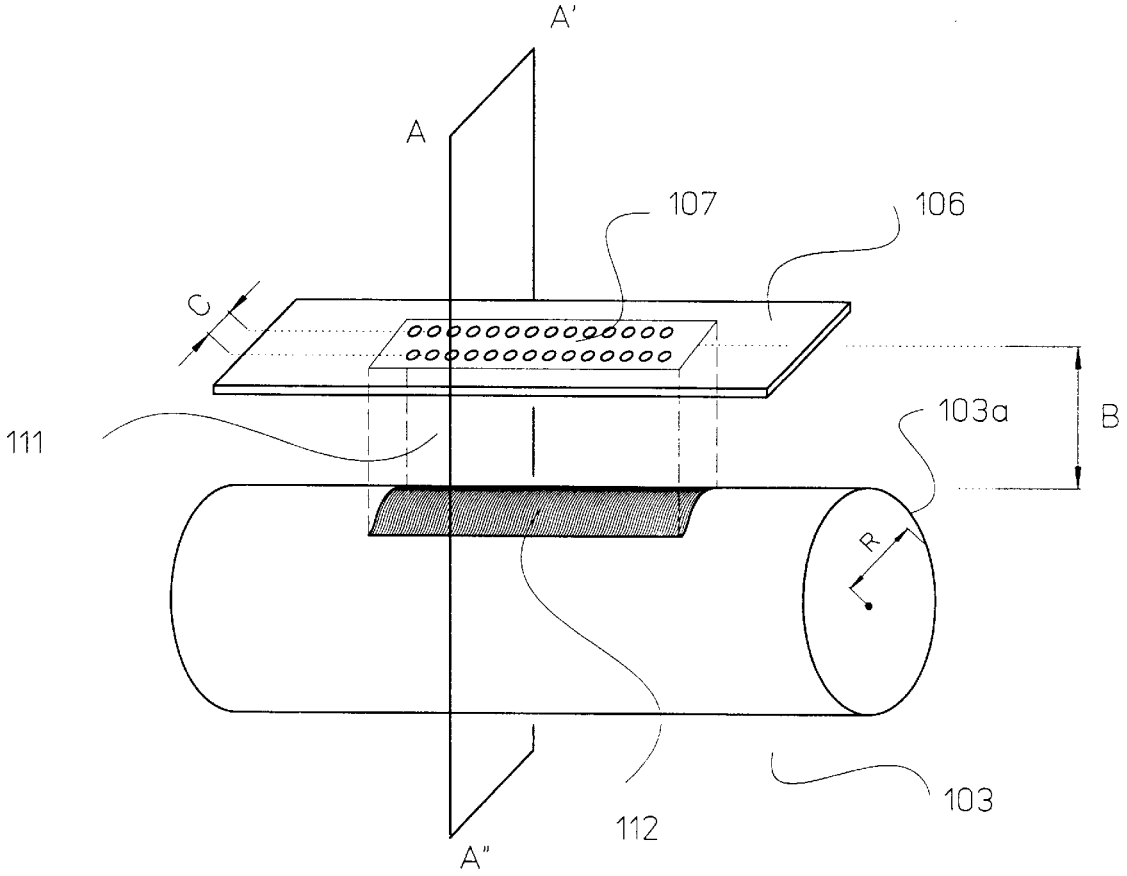
FIG. 2 is a schematic illustration of the development zone.
Figure 3:
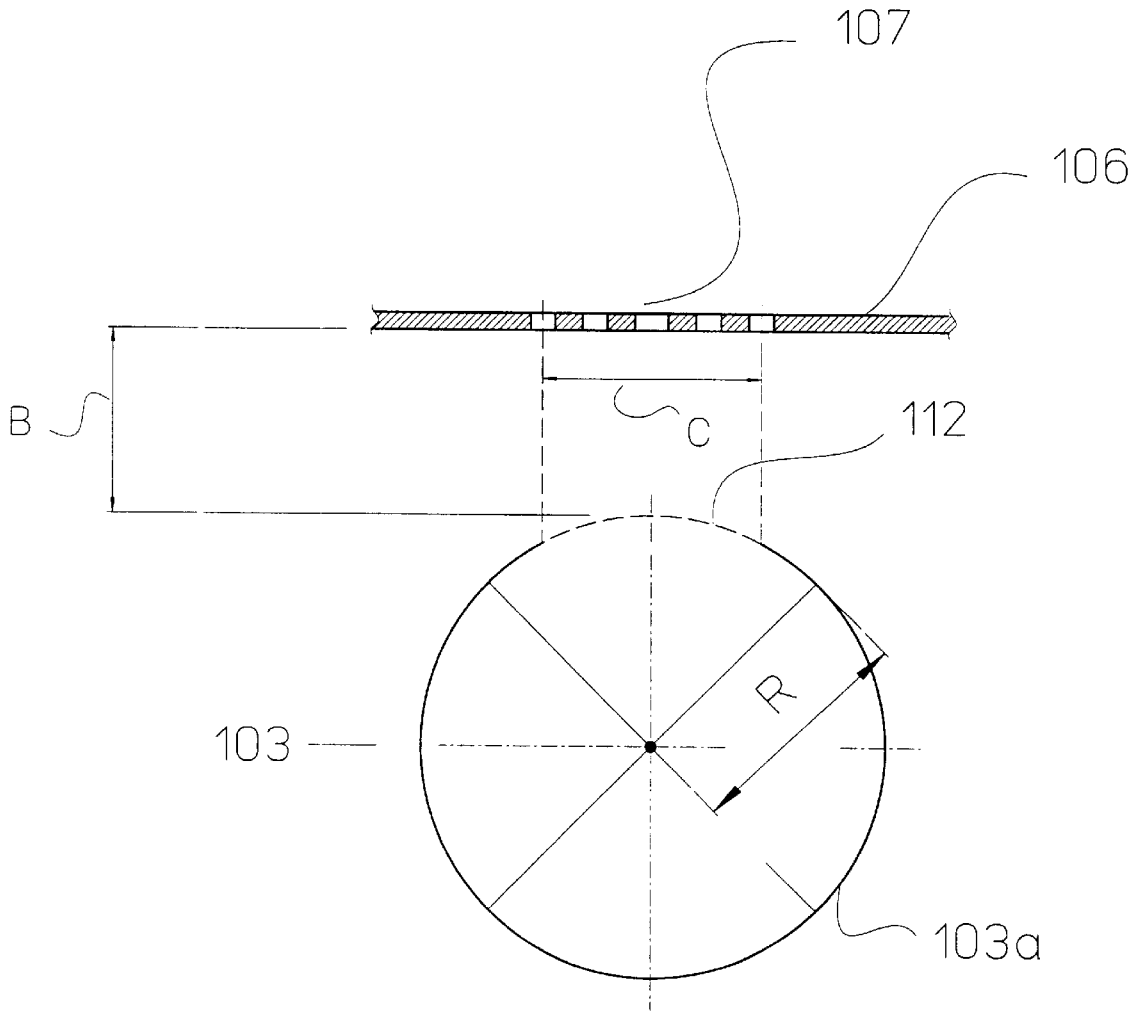
FIG. 3 is a cross-section of FIG. 2 along the plane A-A'-A".

"development zone" is the volume between the printhead structure (106) and the toner delivery means (101), wherein the toner cloud (104) is formed. In FIG. 2, a non-limitative example of a development zone is given. It is the zone (volume) (111) between the printhead structure (106) and the reference surface of the CTC (103), determined by the surface of said printhead structure (106) facing said CTC, the perpendicular planes dropping from the edges of the array of printing apertures (107) to said reference surface of the sleeve **(103*b*) of said cylindrical CTC and said reference surface itself (112)** within the volume determined by said perpendicular planes.

DETAILED DESCRIPTION OF THE INVENTION

It has been found that printing speed and printing quality in DEP devices depend on the amount of charged toner particles that is presented per unity of time in the vicinity of the printing apertures. It was found that an easy and simple way to provide the possibility to control the amount of charged toner particles that is presented per unity of time in the vicinity of the printing apertures, was using, in a DEP device, a CTC whereon the toner particles are provided from a rotating magnetic brush. It was found that it is important to control the ratio of the linear surface speed in mm/s of the sleeve of said magnetic brush (LSM) and of the image receiving substrate (LSS), in order to provide good printing quality and good maximum density.

It was found that a DEP device, wherein the toner particles are provided in the vicinity of a printhead structure (106) by a charged toner conveyer (CTC), having a linear surface speed LSC in mm/s; wherein the charged toner particles are applied to said CTC by a magnetic brush with a sleeve rotating at a linear surface speed LSM in mm/s and wherein the toner image receiving substrate (109) travels at a speed LSS in mm/s, could provide good printing quality and high maximum density when the ratio of said surface speed of said sleeve (LSM) to said speed of said image receiving substrate (LSS) is equal to or larger than 0.50.

It was found, that the achievable maximum density for a given speed of said image receiving substrate (LSS) and for a given ratio of LSM/LSS could be further enhanced by using a DEP device wherein the ratio the linear surface speed of the CTC (LSC) to the linear speed of said image receiving substrate (LSS) was also equal to or larger than 0.5.

The maximum density and the image quality, especially from the point of view of "banding" (i.e. the formation of bands of different density perpendicular on the travelling direction of said image receiving substrate 109), can be enhanced when the linear surface speed of the sleeve of the magnetic brush (LSM) is adapted to the linear surface speed (LSC) of the CTC. The image quality, both from the viewpoint of maximum density and banding is largely enhanced when also LSM/LSC≧0.5. The banding was found to be almost absent in the image when LSM/LSC≧1.00.

In the most preferred embodiment of the present invention, LSM/LSS≧1.50, LSC/LSS≧1.00, LSM/LSC≧1.00.

The quality of the image can further be enhanced, when the surface roughness of the CTC is higher than 0.5 μm when measured as a Ra-roughness according to ANSI/ASME B46.1-1985, preferably higher than 1.0 μm. It was found that the surface roughness of the CTC influences favourably the "cloudiness" of the image. By "cloudiness" is meant an unevenness in the image, especially visible when the image is inspected Dmax in a direction perpendicular to the travelling direction of the image receiving substrate.

The CTC used in a DEP device according to the present invention can have any shape, e.g. a belt supported by one ore more wheels, a belt sliding of a shoe, a cylinder, etc. The material to build said CTC can vary widely, it can be a metal belt, a metallized polymeric belt, a polymeric belt, a metal or polymeric cylinder, etc.

In order to be able to print at higher speed, it is necessary that a DEP device comprises a printhead structure with multiple rows of printing apertures.

Therefore, a DEP device according to the present invention, preferably comprises a printhead structure (106) with several rows of printing apertures (107).

Since printing devices are preferably kept as small as possible, it is interesting to use, in any printing device, the smallest components possible. For that reason a cylindrical CTC with small diameter is preferably used in any electrographic device, and thus also in a DEP device according to the present invention, but then the problem of providing charged toner particles in the vicinity of all printing apertures with a nearly equal flux, rises again. We have experimentally found that there is a maximum curvature (i.e. minimum radius) of the CTC in said development zone that can give good print quality with a printhead comprising a given number of rows of printing apertures. Said given number of rows of printing apertures is in fact the extension of the array of printing apertures in the direction of the movement of the receiving substrate, measured from the middle of the apertures in the first row to the middle of the apertures in the last row. As a result of experimentation it has been found that good printing quality can be obtained with a cylindrically shaped CTC that is not fully parallel to said printhead structure, provided that said CTC has a maximum curvature (minimum radius) given by equation I:

$$R \geq \frac{C^2}{4.25B + 0.25} \qquad \text{I}$$

wherein R is the radius of the sleeve of said cylindrical CTC, B is the distance in mm between the reference surface of the CTC (103) and the printhead structure (106) and C is the extension in mm of the array of printing apertures (107) measured in the direction of arrow A, as described above.

Preferably R fulfills the equation II:

$$R \geq \frac{C^2}{1.55B + 0.25} \qquad \text{II}$$

Most preferably R fulfills the equation III:

$$R \geq \frac{C^2}{0.30B + 0.25} \qquad \text{III}$$

This relation between curvature of said CTC and total extension of the array of printing apertures in said printhead structure is also dependent upon the actual distance of said CTC from said printhead structure.

Preferably, a cylindrical CTC used in a DEP device according to the present invention and fulfilling the equations above, has a radius $R \geqq 10$ mm.

Said cylindrical CTC can be made movable without friction or with reduced friction in any way known in the art. It can e.g. comprise a inner shoe over which a sleeve is rotated without friction, or it can be a hollow cylinder mounted on an axle and being rotated in bearings, etc.

Depending upon the application for which the printing engine according to the DEP-technique as described above has to be used, the printhead structure is fabricated in such a way as to impose the smallest possible implication upon the size and cost of the charged toner conveyer used in the toner application module. In e.g. a printing device with high printing speed of full colour images at medium spatial resolution (i.e. medium sharpness) but high density resolution (i.e. a high number of differentiated density levels), it is advisable to use a CTC with small curvature in the development zone combined with a printhead structure with many rows of apertures, each of said apertures having a rather large diameter. In a printing device with a high spatial resolution but a low density resolution it is advisable to use a low-cost CTC with a small diameter, combined with a printhead structure comprising only a small amount of rows of apertures, each of said apertures having a small diameter.

The printhead structure used in a preferred embodiment of the present invention is made in such a way that reproducible printing is possible without clogging and with accurate control of printing density. Such a printhead structure has been described in U.S. patent application Ser. No. 08/575,775, filed on Dec. 19, 1995, which is incorporated by reference.

The printing apertures in a printhead structure used in a DEP device according to the present invention can have any shape, e.g. circular, elliptical, etc. In a preferred embodiment of the present invention, the printing apertures 107 are square.

DESCRIPTION OF THE DEP DEVICE

A non limitative example of a device for implementing a DEP method using toner particles according to the present invention comprises (FIG. 1):

(i) a toner delivery means (101), comprising a container for developer (102), a charged toner conveyer (103) and a magnetic brush (104), this magnetic brush forming a layer of charged toner particles upon said charged toner conveyer (ii) a back electrode (105)

(iii) a printhead structure (106), made from a plastic insulating film, coated on both sides with a metallic film. The printhead structure (106) comprises one continuous electrode surface, hereinafter called "shield electrode" **(106*b*) facing in the shown embodiment the toner delivering means and a complex addressable electrode structure, hereinafter called "control electrode" (106*a*) around printing apertures (107), facing, in the shown embodiment, the toner-receiving member in said DEP device. Said printing apertures are arranged in an array structure for which the total number of rows can be chosen according to the field of application. The location and/or form of the shield electrode (106*b*) and the control electrode (106*a*) can, in other embodiments of a device for a DEP method using toner particles according to the present invention, be different from the location shown in FIG. 1**.

(iv) conveyer means (108) to convey an image receptive member (109) for said toner between said printhead structure and said back electrode in the direction indicated by arrow A.

(v) means for fixing (110) said toner onto said image receptive member.

Figure 1:
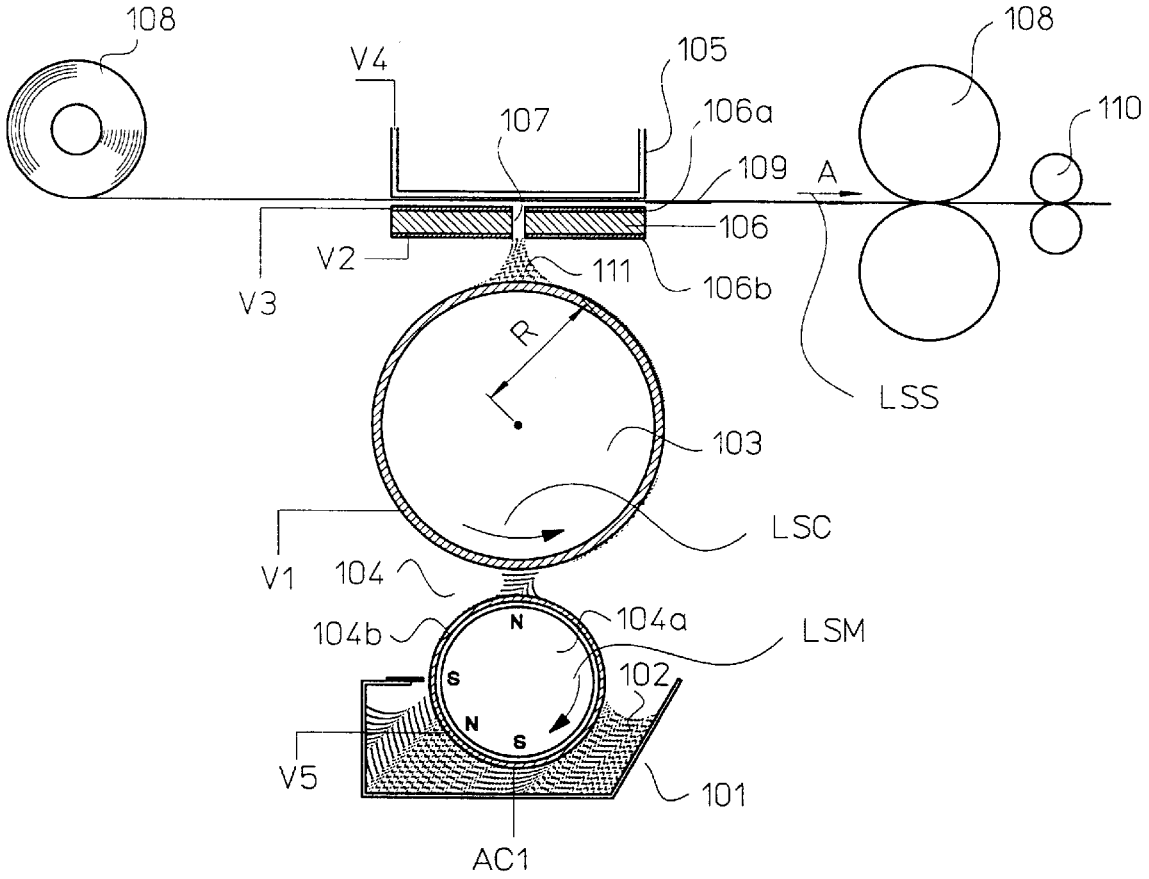
FIG. 1 is a schematic illustration of a possible embodiment of a DEP device according to the present invention.

Although in FIG. 1 an embodiment of a device for a DEP method using two electrodes (106*a* and 106*b*) on printhead 106 is shown, it is possible to implement a DEP method, using toner particles according to the present invention using devices with different constructions of the printhead (106). It is, e.g. possible to implement a DEP method with a device having a printhead comprising only one electrode structure as well as with a device having a printhead comprising more than two electrode structures. The apertures in these printhead structures can have a constant diameter, or can have a broader entrance or exit diameter. The printhead structure used in a DEP device according to the present invention can also be a mesh of wire electrode as described in, e.g., EP-A-390 847. The back electrode (105) of this DEP device can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

Between said printhead structure (106) and the charged toner conveyer (103) as well as between the control electrode around the apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, using a printing device with a geometry according to the present invention, shown in FIG. 1. voltage V1 is applied to the sleeve of the charged toner conveyer 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a timebasis or grey-level basis. Voltage V4 is applied to the back electrode behind the toner receiving member. In other embodiments of the present invention multiple voltages $V2_0$ to $V2_n$ and/or $V4_0$ to $V4_n$ can be used. Voltage V5 is applied to the surface of the sleeve of the magnetic brush.

A DEP device according to the present invention can be operated successfully when a single magnetic brush with multi-component developer, comprising magnetic carrier particles and non-magnetic toner particles is used in contact with the CTC to provide a layer of charged toner on said CTC.

Figure 4:
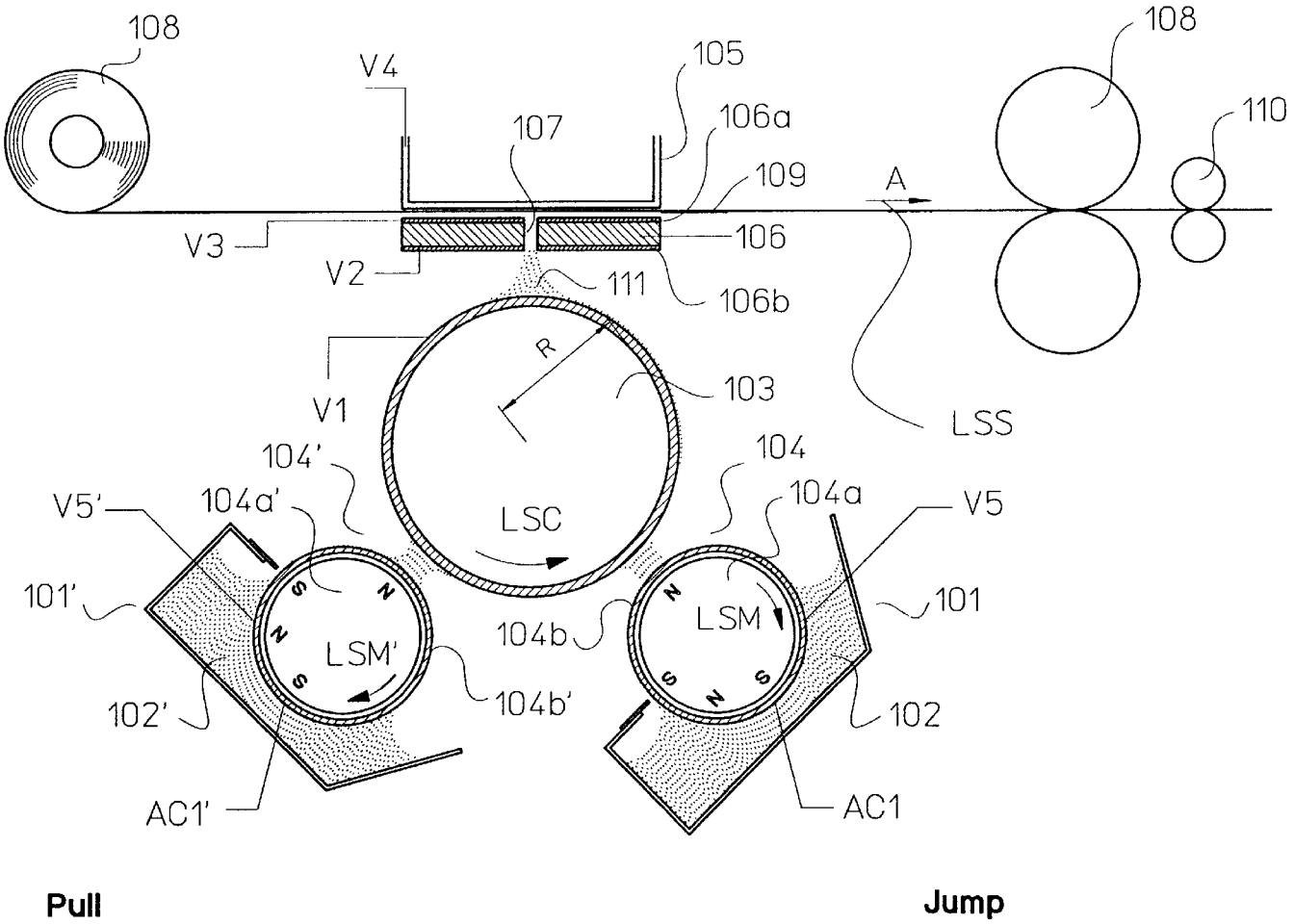

In a DEP device according to a preferred embodiment of the present invention as shown in FIG. 4, said toner delivery means (101, 101') creates a layer of toner particles upon said charged toner conveyer using two magnetic brushes with multi-component developer (e.g. a two-component developer, comprising carrier and toner particles wherein the toner particles are triboelectrically charged by the contact with carrier particles or 1.5 component developers, wherein the toner particles get tribo-electrically charged not only by contact with carrier particles, but also by contact between the toner particles themselves). The first of said two magnetic brushes is a pushing magnetic brush 104, used to jump charged toner particles 102 to said CTC and being connected to a DC-source V5 with the same polarity as the toner particles. The second of said two magnetic brushes is pulling magnetic brush, used to remove toner particles 102' from said CTC and connected to a DC-source V5' with a polarity opposite to the polarity of the toner particles. By adapting the respective voltages (V5, V5') applied to the surface of the respective sleeves (104*b*, 104*b*') the resulting push/pull mechanism provides a way of applying a highly homogeneous layer of well behaved charged toner particles upon said charged toner conveyer. The first of said magnetic brushes was located at the side of said CTC where the jumped toner particles were carried in the direction of the movement of said CTC towards the printing apertures in said printhead structure. The second of said magnetic brushes was located at the other side of the CTC, namely at the side were unused toner particles that have passed under the printing apertures of said printhead structure are removed.

In a DEP device according to the present invention where a "jumping" magnetic brush 104 and a "pulling" magnetic brush 104' are used, it is the linear surface speed of the "jumping" magnetic brush that is meant when the abbreviation LSM is used. It is important to control the relationships of said surface speed LSM of said "jumping" magnetic brush with both the linear speed of the image receiving member (LSS) and the linear speed of the CTC (LSC). The relationship of the linear speed of the "pulling" magnetic brush LSM' to both other speeds cited immediately above does not require such a strict control.

In a DEP device according to the present invention an additional AC-source AC1 can beneficially be connected to the sleeve of a single magnetic brush or multiple AC-sources AC1 and AC1' may be connected to the sleeves 104*b* 104*b*', respectively, of a device using multiple magnetic brushes.

The magnetic brushes 104 and 104' preferentially used in a DEP device according to the present invention are of the type with stationary cores 104*a* and 104*a*' and rotating sleeves 104*b* and 104*b* ', respectively.

In a DEP device, according to a preferred embodiment of the present invention, any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behaviour, characterised in coercivity values ranging from about 50 up to 250 Oe. Further very useful soft magnetic carrier particles, for use in a DEP device according to a preferred embodiment of the present invention, are composite carrier particles, comprising a resin binder and a mixture of two magnetites having a different particle size as described in EP-B 289 663. The particle size of both magnetites will vary between 0.05 and 3 $\mu$m. The carrier particles have preferably an average volume diameter ($d_{v50}$) between 10 and 300 $\mu$m, preferably between 20 and 100 $\mu$m. More detailed descriptions of carrier particles, as mentioned above, can be found in EP-A 675 417, titled "A method and device for direct electrostatic printing (DEP)", that is incorporated herein by reference.

It is preferred to use in a DEP device according to the present invention, toner particles with an absolute average charge ($|q|$) corresponding to 1 fC $\leqq |q| \leqq$ 20 fC, preferably to 1 fC $\leqq |q| \leqq$ 10 fC. The absolute average charge of the toner particles is measured by an apparatus sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 $\mu$m). From the absolute average charge per 10 $\mu$m ($|q|/10$ $\mu$m) the absolute average charge $|q|$ is calculated. Moreover it is preferred that the charge distribution is narrow, i.e. shows a distribution wherein the coefficient of variability (v), i.e. the ratio of the standard deviation to the average value, is equal to or lower than 0.33. Preferably the toner particles used in a device according to the present invention have an average volume diameter ($d_{v50}$) between 1 and 20 μm, more preferably between 3 and 15 μm. More detailed descriptions of toner particles, as mentioned above, can be found in EP-A 675 417, titled "A method and device for direct electrostatic printing (DEP)", that is incorporated herein by reference.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution and of the multiple grey level capabilities typical for DEP, opens the way for multilevel halftoning techniques,, such as e.g. described in the EP-A 634 862. This enables the DEP device, according to the present invention, to render high quality images.

EXAMPLES

Throughout the printing examples, the same developer, comprising toner and carrier particles was used.

The carrier particles

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner particles

The toner used for the experiment had the following composition: 97 parts of a co-polyester resin of fumaric acid and bispropoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following formula: $(CH_3)_3N^+C_{16}H_{33}$ $Br^-$was added in a quantity of 0.5% with respect to the binder, as described in WO 94/027192. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The average particle size was measured by Coulter Counter model Multisizer (tradename), was found to be 6.3 μm by number and 8.2 μm by volume. In order to improve the flowability of the toner mass, the toner particles were mixed with 0.5% of hydrophobic colloidal silica particles (BET-value 130 $m^2$ /g).

The developer

An electrostatographic developer was prepared by mixing said mixture of toner particles and colloidal silica in a 4% ratio (w/w) with carrier particles. The triboelectric charging of the toner-carrier mixture was performed by mixing said mixture in a standard tumbling set-up for 10 min. The developer mixture was run in the magnetic brush for 5 minutes, after which the toner was sampled and the triboelectric properties were measured, according to a method as described in the above mentioned EP-A 675 417. The average charge, q, of the toner particles was −7.1 fC.

The printhead structure (106)

Throughout all examples the same printhead structure was used. A printhead structure 106 was made from a polyimide film of 50 μm thickness, double sided coated with a 17 μm thick copper film. On the back side of the printhead structure, facing the receiving member substrate, a ring shaped control electrode 106*a* was arranged around each aperture. Each of said control electrodes was individually addressable from a high voltage power supply. On the front side of the printhead structure, facing the toner delivery means, a common shield electrode (106*b*) was present. The printhead structure 106 comprised a four-rowed-array of printing apertures. The extension of said array of printing apertures (C in mm) as defined above was 1.95 mm. The apertures had an aperture diameter of 200 μm. The width of the copper ring electrodes was 175 μm. The rows of apertures were staggered to obtain an overall resolution of 200 dpi.

For the fabrication process of the printhead structure, conventional methods of copper etching and mechanical drilling were used, as known to those skilled in the art.

The toner delivery means (101)

In all examples, the toner delivery means 101 comprised a cylindrical charged toner conveyer (103). The charged toner conveyer 103 was connected to an AC power supply with a square wave oscillating field of 600 V at a frequency of 3.0 kHz with +20 V DC-offset. The CTC was a cylinder with a sleeve made of aluminum, coated with TEFLON (trade name of Du Pont, Wilmington, USA) with a surface roughness of 2.2 μm (Ra-value) and a diameter of 30 mm In the different examples, the linear surface speed (LSC in mm/s) of the charged toner conveying means (CTC) was changed. And in two more examples, the surface roughness of said CTC was changed at constant linear surface speed.

Charged toner was propelled to this conveyer from a stationary core/rotating sleeve type magnetic brush (104) comprising two mixing rods and one metering roller. One rod was used to transport the developer through the unit, the other one to mix toner with developer.

The magnetic brush 104 was constituted of the so called magnetic roller, which in this case contained inside the roller assembly a stationary magnetic core, having three magnetic poles with an open position (no magnetic poles present) to enable used developer to fall off from the magnetic roller (open position was one quarter of the perimeter and located at the position opposite to said CTC (103).

The sleeve of said magnetic brush had a diameter of 20 mm and was made of stainless steel roughened with a fine grain to assist in transport (Ra=3 μm) and showed an external magnetic field strength in the zone between said magnetic brush and said CTC of 0.045 T, measured at the outer surface of the sleeve of the magnetic brush.

A scraper blade was used to force developer to leave the magnetic roller. On the other side a doctoring blade was used to meter a small amount of developer onto the surface of said magnetic brush. Depending on the example, the sleeve was rotating at different linear surface speeds (LSM in mm/sec), the internal elements rotating at such a speed as to conform to a good internal transport within the development unit. The magnetic brush 104 was connected to a DC power supply of −120 V. The reference surface of said CTC was placed at a distance of 600 μm from the reference surface of said magnetic brush.

The printing engine

The distance B between the front side of the printhead structure 106 and the sleeve (reference surface) of the charged toner conveyer 103, was set at 400 μm. The distance between the back electrode 105 and the back side of the printhead structure 106 (i.e. control electrodes 106*a*) was set to 150 μm and the paper travelled at 50 mm/sec. The shield electrode 106*b* was grounded: V2 =0 V. To the individual control electrodes an (imagewise) voltage V3 between 0 V and −300 V was applied. The back electrode 105 was connected to a high voltage power supply of +600 V. To the sleeve of the CTC an AC voltage of 600 V at 3.0 kHz was applied, with +20 V DC offset.

The linear surface speed of the CTC (LSC), of the sleeve of the magnetic brush (LSM), the paper speed (LSS) and the ratios LSM/LSS, LSC/LSS and LSM/LSC for each example and comparative example are reported in table 1.

Measurement of printing quality

A printout made on paper with a DEP device and developer described above, was judged for homogeneity of the image density and the maximal achieved density, measured in reflection mode with a Macbeth Desitometer (Type TR1224). The results are given in table 2. In this table the data on banding are summarized according to the following ranking:

1: unacceptable: severe banding.

2: poor: banding still clearly visible.

3: acceptable: very little banding visible.

4: good: banding barely visible.

5: very good: an homogeneous image density is obtained, with almost no banding visible.

The results on cloudiness, together with the results on $D_{max}$ and banding, are, were appropriate, given in table 3. In this table the data on cloudiness are summarized according to the following ranking 1: unacceptable: severe cloudiness.

2: poor: cloudiness still clearly visible.

3: acceptable: very little cloudiness visible.

4: good: cloudiness barely visible.

5: very good: an homogeneous image density is obtained, with almost no cloudiness visible.

In examples 1 to 10 and comparative examples 1 to 6, a CTC with diameter 30 mm was used, i.e. $R_{real}$ =15 mm. The distance B between the surface of the CTC and the printhead structure was 0.4 mm and the extension of the array of four rows of printing apertures (C in mm) as defined above was 1.95 mm. When calculating the minimal R, according to formulas I, II and III, it is found that $R_{min}$ is 1.95, 4.37 and 10.27 mm respectively. This means that in the printing situation in these examples $R_{real}$ is even greater than the $R_{min}$ calculated with formula III.

EXAMPLE 1 (E1)

The charged toner conveyer (the toner delivery means) was rotated at a linear surface speed LSC of 50 mm/s. The charged toner conveyer 103 was connected to an AC power supply with a square wave oscillating field of 600 V at a frequency of 3.0 kHz with 0 V DC-offset.

Charged toner was propelled to this conveyer from a stationary core/rotating sleeve type magnetic brush (104). The sleeve of said magnetic brush rotated at a linear speed LSM of 50 mm/s.

The paper (the image receiving substrate 109) travelled at a linear speed of 50 mm/s.

The results of the printing, with respect to maximum density ($D_{max}$) and banding are reported in table 2.

EXAMPLE 2 (E2)

In example 2 a print was made with the same printhead structure, CTC and magnetic brush as described in example 1, except for the fact that said CTC was rotated at a linear speed of 50 mm/s, the sleeve of the magnetic brush rotated again at a linear speed LSM of 75 mm/S.

The paper (the image receiving substrate 109) travelled at a linear speed of 50 mm/s.

The results of the printing, with respect to maximum density (Dmax) and banding are reported in table 2.

EXAMPLE 3 (E3)

In example 3 a print was made with the same printhead structure, CTC and magnetic brush as described in example 1. Except for the fact that said CTC was rotated at a linear speed of 50 mm/s, the sleeve of the magnetic brush rotated again at a linear speed LSM of 150 mm/s.

The paper (the image receiving substrate 109) travelled at a linear speed of 50 mm/s.

The results of the printing, with respect to maximum density ($D_{max}$) and banding are reported in table 2.

EXAMPLE 4 (E4)

In example 4 a print was made with the same printhead structure, CTC and magnetic brush as described in example 1. Except for the fact that said CTC was rotated at a linear speed of 50 mm/s, the sleeve of the magnetic brush rotated again at a linear speed LSM of 300 mm/s.

The paper (the image receiving substrate 109) travelled at a linear speed of 50 mm/s.

The results of the printing, with respect to maximum density ($D_{max}$) and banding are reported in table 2.

EXAMPLE 5 (E5)

Example 4 was repeated except for the fact that a "jumping" and a "pulling" magnetic brush were used. A first magnetic brush was used to feed the charged toner particles to said CTC and a second magnetic brush was used to remove most of said charged toner particles from said CTC. Both magnetic brushes were from the same construction as described above. The first of said brushes was located at the side of said CTC where the jumped toner particles were carried in the direction of the movement of said CTC towards the printing apertures in said printhead structure. The second of said brushes was located at the other side of the CTC, namely at the side were unused toner particles that have passed under the printing apertures of said printhead structure are removed. The sleeve of the first of said magnetic brushes was connected to a DC power supply of −200 V, the sleeve of the second of said magnetic brushes was connected to a DC power supply of +200 V. The sleeve of said CTC was connected to an AC power supply with a square wave oscillating field of 600 V at a frequency of 3.0 kHz with 20 V DC-offset. The first of said magnetic brushes (the "jumping" magnetic brush) was rotated at a linear speed LSC of 300 mm/s, the second at a linear speed of 250 mm/s. The distance of both of said magnetic brushes towards said CTC was set to 500 μm and the distance of said CTC to said printhead structure was set to 400 μm. The CTC was rotated at a linear speed of 50 mm/s.

The paper (the image receiving substrate 109) travelled at a linear speed of 50 mm/s.

The results of the printing, with respect to maximum density ($D_{max}$) and banding are reported in table 2.

EXAMPLE 6 (E6)

In example 6 a print was made with the same printhead structure, CTC and magnetic brush as described in example 1. Except for the fact that said CTC was rotated at a linear speed of 75 mm/s and that the sleeve of the magnetic brush rotated again at a linear speed LSM of 75 mm/s.

The paper (the image receiving substrate 109) travelled at a linear speed of 50 mm/s.

The results of the printing, with respect to maximum density ($D_{max}$) and banding are reported in table 2, in table 3 these measurements are reported again together with the measurement of cloudiness.

EXAMPLE 7 (E7)

In example 7 a print was made with the same printhead structure, CTC and magnetic brush as described in example 1. Except for the fact that said CTC was rotated at a linear speed of 150 mm/s and that the sleeve of the -magnetic brush rotated again at a linear speed LSM of 150 mm/s.

The paper (the image receiving substrate 109) travelled at a linear speed of 50 mm/s.

The results of the printing, with respect to maximum density ($D_{max}$) and banding are reported in table 2.

EXAMPLE 8 (E8)

In example 8 a print was made with the same printhead structure, CTC and magnetic brush as described in example 1. Except for the fact that said CTC was rotated at a linear speed of 300 mm/s and that the sleeve of the magnetic brush rotated at a linear speed LSM of 400 mm/s.

The paper (the image receiving substrate 109) travelled at a linear speed of 50 mm/s.

The results of the printing, with respect to maximum density ($D_{max}$) and banding are reported in table 2.

Comparative Example 1 (C1)

In comparative example 1 a print was made with the same printhead structure, CTC and magnetic brush as described in example 1. Except for the fact that said CTC was rotated at a linear speed of 50 mm/s and that the sleeve of the magnetic brush rotated at a linear speed LSM of 22.5 mm/s.

The paper (the image receiving substrate 109) travelled at a linear speed of 50 mm/s.

The results of the printing, with respect to maximum density ($D_{max}$) and banding are reported in table 2.

Comparative Example 2 (C2)

In comparative example 2 a print was made with the same printhead structure, CTC and magnetic brush as described in example 1. Except for the fact that said CTC was rotated at a linear speed of 150 mm/s and that the sleeve of the magnetic brush rotated at a linear speed LSM of 22.5 mm/s.

The paper (the image receiving substrate 109) travelled at a linear speed of 50 mm/s.

The results of the printing, with respect to maximum density ($D_{max}$) and banding are reported in table 2.

Comparative Example 3 (C3)

In comparative example 3 a print was made with the same printhead structure, CTC and magnetic brush as described in example 1. Except for the fact that said CTC was rotated at a linear speed of 22.5 mm/s and that the sleeve of the magnetic brush rotated at a linear speed LSM of 50 mm/s.

The paper (the image receiving substrate 109) travelled at a linear speed of 50 mm/s.

The results of the printing, with respect to maximum density ($D_{max}$) and banding are reported in table 2.

Comparative Example 4 (C4)

In comparative example 4 a print was made with the same printhead structure, CTC and magnetic brush as described in example 1. Except for the fact that said CTC was rotated at a linear speed of 22.5 mm/s and that the sleeve of the magnetic brush rotated at a linear speed LSM of 150 mm/s.

The paper (the image receiving substrate 109) travelled at a linear speed of 50 mm/s.

The results of the printing, with respect to maximum density ($D_{max}$) and banding are reported in table 2.

Comparative Example 5 (C5)

In comparative example 5 a print was made with the same printhead structure, CTC and magnetic brush as described in example 1. Except for the fact that said CTC was rotated at a linear speed of 75 mm/s and that the sleeve of the magnetic brush rotated at a linear speed LSM of 50 mm/s.

The paper (the image receiving substrate 109) travelled at a linear speed of 50 mm/s.

The results of the printing, with respect to maximum density ($D_{max}$) and banding are reported in table 2.

Comparative Example 6 (C6)

In comparative example 6 a print was made with the same printhead structure, CTC and magnetic brush as described in example 1. Except for the fact that said CTC was rotated at a linear speed of 300 mm/s and that the sleeve of the magnetic brush rotated at a linear speed LSM of 50 mm/s.

The paper (the image receiving substrate 109) travelled at a linear speed of 50 mm/s.

The results of the printing, with respect to maximum density ($D_{max}$) and banding are reported in table 2.

EXAMPLE 9 (E9)

In example 9, example 6 was repeated but the surface roughness of the CTC was 0.38 $\mu$m instead of 2.2 $\mu$m. The CTC was rotated at a linear speed of 75 mm/s and that the sleeve of the magnetic brush rotated at a linear speed LSM of 75 mm/s.

The paper (the image receiving substrate 109) travelled at a linear speed of 50 mm/s.

The results of the printing, with respect to maximum density ($D_{max}$) and banding and cloudiness are reported in table 2.

EXAMPLE 10 (E10)

In example 10, example 9 was repeated but the surface roughness of the CTC was 3.6 $\mu$m instead of 0.38 $\mu$m.

TABLE 1

| N° | LSC* | LSM** | LSS† | LSM/LSS | LSC/LSS | LSM/LSC |
|---|---|---|---|---|---|---|
| E1 | 50 | 50 | 50 | 1.00 | 1.00 | 1.00 |
| E2 | 50 | 75 | 50 | 1.50 | 1.00 | 1.50 |

TABLE 1-continued

| N° | LSC* | LSM** | LSS† | LSM/LSS | LSC/LSS | LSM/LSC |
|---|---|---|---|---|---|---|
| E3 | 50 | 150 | 50 | 3.00 | 1.00 | 3.00 |
| E4 | 50 | 300 | 50 | 6.00 | 1.00 | 6.00 |
| E5 | 50 | 300 | 50 | 6.00 | 1.00 | 6.00 |
| E6 | 75 | 75 | 50 | 1.50 | 1.50 | 1.00 |
| E7 | 150 | 150 | 50 | 3.00 | 3.00 | 1.00 |
| E8 | 300 | 400 | 50 | 8.00 | 6.00 | 1.33 |
| C1 | 50 | 22.5 | 50 | 0.45 | 1.00 | 0.45 |
| C2 | 150 | 22.5 | 50 | 0.45 | 3.00 | 0.15 |
| C3 | 22.5 | 50 | 50 | 1.00 | 0.45 | 2.22 |
| C4 | 22.5 | 150 | 50 | 3.00 | 0.45 | 6.67 |
| C5 | 75 | 50 | 50 | 1.00 | 1.50 | 0.67 |
| C6 | 300 | 50 | 50 | 1.00 | 6.00 | 0.17 |

*linear surface speed of the charged toner conveyer in mm/s
**linear surface speed of the magnetic brush in mm/s
†linear surface speed of the image receiving substrate in mm/s

TABLE 2

| N° | LSM/LSS | LSC/LSS | LSM/LSC | $D_{max}$ | Banding |
|---|---|---|---|---|---|
| E1 | 1.00 | 1.00 | 1.00 | 0.45 | 3 |
| E2 | 1.50 | 1.00 | 1.50 | 0.68 | 4 |
| E3 | 3.00 | 1.00 | 3.00 | 0.73 | 4 |
| E4 | 6.00 | 1.00 | 6.00 | 0.75 | 5 |
| E5 | 6.00 | 1.00 | 6.00 | 0.87 | 5 |
| E6 | 1.50 | 1.50 | 1.00 | 0.65 | 4 |
| E7 | 3.00 | 3.00 | 1.00 | 0.75 | 4 |
| E8 | 8.00 | 6.00 | 1.33 | 0.90 | 5 |
| C1 | 0.45 | 1.00 | 0.45 | 0.12 | |
| C2 | 0.45 | 3.00 | 0.15 | 0.02 | |
| C3 | 1.00 | 0.45 | 2.22 | 0.23 | |
| C4 | 3.00 | 0.45 | 6.67 | 0.17 | |
| C5 | 1.00 | 1.50 | 0.67 | 0.43 | 2 |
| C6 | 1.00 | 6.00 | 0.17 | 0.37 | 1 |

TABLE 3

| N° | Roughness Ra in $\mu$m | $D_{max}$ | Banding | Cloudiness |
|---|---|---|---|---|
| E6 | 2.2 | 0.65 | 4 | 4 |
| E9 | 0.38 | 0.67 | 4 | 1 |
| E10 | 3.6 | 0.64 | 4 | 5 |

In examples 11 to 20 and comparative examples 7 and 8 the printing quality with DEP devices having different CTC's having different diameters, different head structures, and varying distances between the surface of the CTC and the printhead structure was investigated.

In examples 11 to 14 and comparative example 3, LSM/LSS was 10, LSC/LSS was 5 and LSM/LSC was 2. In examples 15 and 16 and comparative example 2, LSM/LSS was 8.4, LSC/LSS was 5 and LSM/LSC was 1.68. In examples 17 to 20, LSM/LSS was 7.8, LSC/LSS was 5 and LSM/LSC was 1.57.

The particulars of the examples 11 to 20 and comparative example 7 and 8 are summarized hereinafter.

The toner, carrier particles, developer mixture and magnetic brush were the same as the ones used for examples 1 to 10 and comparative examples 1 to 6. The printhead structure had basically the same structure as the one used in the examples and comparative examples hereinbefore, except for the number of rows of printing apertures. Also the toner delivery means was in principle the same except for the variation in radius (curvature). All voltages and magnetic strengths were also equal to the ones used in the examples and comparative examples hereinbefore.

The variables in the following examples 11 to 20 and comparative examples 7 and 8 are given hereinbelow and are summarized in table 4.

Measurement of printing quality

A printout made with a DEP device and developer described above, was judged for homogeneity of the image density. The results are given in table 5. In this table the data are summarized according to the following ranking:

1: unacceptable: different rows of apertures are not giving any density at all.

2: poor: toner particles are passing through all printing apertures but some of said rows of apertures have such a small density value that correction of said low-density printing apertures by applying a different voltage to said control electrodes in said rows of apertures does not yield an homogeneous image density.

3: acceptable: the overall image density can be tuned to be homogeneous by changing the voltage applied to some control electrodes of some printing apertures, but the overall printing speed is lowered considerably.

4: good: only small corrections have to be performed for some of the control electrodes in order to become a homogeneous image density.

5: excellent: an homogeneous image density is obtained without any minor changes to the control electrodes of any printing aperture.

The relevant parameters of the printing engines, the radius of the CTC (R), the distance between the reference surface of the CTC and the printhead structure (B) and the extension of the array of rows of printing a pertures (C), used in each of the examples, are summarized in table 4.

In table 5, the printing quality of each of the examples is shown together with the figures, showing how well R fulfills the equations I, II and III.

EXAMPLE 11 (E11)

A printhead structure with 6 rows of apertures and an extension (C) in the direction of the printing of 3.25 mm was placed at a distance (B) from a CTC of 0.35 mm, the radius of the CTC was 10 mm. The paper travel fed at 10 mm/sec.

EXAMPLE 12 (E12)

In example 12 a print was made with the same printhead configuration and CTC as described in example 11, but the distance of said CTC towards said printhead structure was set to 500 $\mu$m.

Comparative Example 7 (CE7)

In comparative example 7 the same CTC as described in example 11 was used, but for the printhead structure, an eight-rowed-array of printing apertures was used (same aperture diameter, copper-ring diameter and staggering). The extension of said array of printing apertures as defined above was 4.55 mm. The distance of said CTC towards said printhead structure was set to 350 $\mu$m.

EXAMPLE 13 (E13)

In example 13 the same CTC as described in example 11 was used, but for the printhead structure, a four-rowed-array of printing apertures was used (same aperture diameter, copper-ring diameter and staggering). The extension of said array of printing apertures as defined above was 1.95 mm. The distance of said CTC towards said printhead structure was set to 500 $\mu$m.

EXAMPLE 14 (E14)

In example 14 the same CTC as described in example 11 was used, but for the printhead structure, a compact design was chosen. The printhead structure was formed of 2 rows of apertures, said apertures having a square form of 200 by 200 μm, a square copper electrode of 50 μm around each aperture, said 2 rows of apertures isolated from each other by a 100 μm broad isolation zone. This printhead structure had a resolution of 127 dpi and was fabricated using the technique of plasma etching. The extension of said array of printing apertures in said printhead structure was only 0.4 mm. The distance of said CTC towards said printhead structure was set to 350 μm.

EXAMPLE 15 (E15)

In example 15 a printhead structure having an eight-rowed-array of printing apertures was used (200 μm aperture diameter, copper-ring diameter of 550 μm and staggered to obtain an overall resolution of 127 dpi). The extension of said array of printing apertures as defined above was 4.55 mm. The CTC had a sleeve with outer diameter of 40 mm and a surface roughness of 3.0 μm (Ra), and was fed from the same magnetic brush as described in example 11. The CTC was rotated at a speed of 40 rpm. The distance of said magnetic brush towards said CTC was set to 500 μm and the distance of said CTC to said printhead structure was set to 500 μm.

EXAMPLE 16 (E16)

In example 16 a printhead structure was used, having 8 rows of printing apertures, each aperture having a diameter of 300 μm, and a copper electrode ring with a width of 200 μm. Each row of apertures was further separated from each other by an additional isolating zone of 200 μm. As printhead substrate a 125 μm thick PI-foil was used. The 8 rows of printing apertures were staggered to obtain an overall printing resolution of 100 dpi. The extension of said array of printing apertures in said printhead structure was 6.30 mm. The CTC as described in example 15 was used. The CTC was placed at 500 μm from said printhead structure.

Comparative Example 8 (CE8)

In comparative example 8 a print was made with the same printhead structure and CTC as described in example 16, but the distance of said CTC towards said printhead structure was set to 400 μm.

EXAMPLE 17 (E17)

In example 17 the same printhead structure as described in example 16 was used. The CTC had an aluminium sleeve with outer diameter of 60 mm and a TEFLON (trade name) coating and a surface roughness of 3.2 μm (Ra), and was fed from the same magnetic brush as described in example 11. The CTC was rotated at a speed of 25 rpm. The distance of said magnetic brush towards said CTC was set to 500 m and the distance of said CTC to said printhead structure was set to 700 μm.

EXAMPLE 18 (E18)

In example 18 a print was made with the same printhead structure and CTC as described in example 17, but the CTC was placed at a distance of 400 μm from said printhead structure.

EXAMPLE 19 (E19)

In example 19 a print was made with the same printhead structure as described in example 15 and the same CTC as described in example 17, and the CTC was placed at a distance of 400 μm from said printhead structure.

EXAMPLE 20 (E20)

In example 20 a print was made with the same printhead structure as described in example 13 and the same CTC as described in example 17, and the CTC was placed at a distance of 400 μm from said printhead structure.

TABLE 4

| Example | R* | B** | C*** |
|---|---|---|---|
| E11 | 10.0 | 0.35 | 3.25 |
| E12 | 10.0 | 0.50 | 3.25 |
| CE7 | 10.0 | 0.35 | 4.55 |
| E13 | 10.0 | 0.50 | 1.95 |
| E14 | 10.0 | 0.35 | 0.40 |
| E15 | 20.0 | 0.50 | 4.55 |
| E16 | 20.0 | 0.50 | 6.30 |
| CE8 | 20.0 | 0.40 | 6.30 |
| E17 | 30.0 | 0.70 | 6.30 |
| E18 | 30.0 | 0.40 | 6.30 |
| E19 | 30.0 | 0.40 | 4.55 |
| E20 | 30.0 | 0.40 | 1.95 |

*R is the radius (expressed in mm) of the cylindrically shaped CTC (103).
**B is the distance in mm, between the reference surface of the CTC and the printhead structure.
***C is the extension in mm of said array of printing apertures (107) in the direction of the movement of said receiving substrate (109).

TABLE 5

| Example | $R_{min}$ Equa. I | $R_{min}$ Equa. II | $R_{min}$ Equa. III | $R_{real}$ | Quality |
|---|---|---|---|---|---|
| E11 | 6.08 | 13.13 | 29.75 | 10.0 | 3 |
| E12 | 4.45 | 10.30 | 26.47 | 10.0 | 4 |
| CE7 | 11.92 | 26.12 | 58.32 | 10.0 | 1 |
| E13 | 1.60 | 3.71 | 9.51 | 10.0 | 5 |
| E14 | 0.09 | 0.20 | 0.45 | 10.0 | 5 |
| E15 | 8.72 | 20.20 | 51.76 | 20.0 | 4 |
| E16 | 16.71 | 38.72 | 99.23 | 20.0 | 3 |
| CE8 | 20.35 | 45.62 | 107.27 | 20.0 | 1 |
| E17 | 12.31 | 29.73 | 86.28 | 30.0 | 4 |
| E18 | 20.35 | 45.62 | 107.27 | 30.0 | 3 |
| E19 | 10.62 | 23.80 | 55.95 | 30.0 | 4 |
| E20 | 1.95 | 4.37 | 10.28 | 30.0 | 5 |

In table 5, columns 1 to 3 the minimal radius, R, necessary for good printing, calculated according to equation I, II and III respectively, using the values of B and C from table 4, is reported. Column 4 gives the real R corresponding with the CTC that was used. The values reported in this column are taken from the second column of table 4. In column 5, the printing quality is given in values from 1 to 5, 5 being the highest quality.

From table 5 it is clear that the best results are obtained when the radius, R, fulfills even equation III. When R fulfills no equation at all, the printing quality is very bad, see CE7 and CE8.

We claim:

1. A direct electrostatic printing device comprising:

a back electrode having a first electrical potential;

a charged toner conveyer having a reference surface and a first rotational means for rotating said reference surface at a linear surface speed, LSC, around a first rotation axis, said reference surface being at a second electrical potential different from the first electrical potential, whereby charged toner particles deposited on said reference surface are electrically attracted toward said back electrode;

a magnetic brush having a core, a sleeve surrounding said core, a second rotational means for rotating said sleeve at a linear surface speed, LSM, around a second rotation axis, and means for applying charged toner particles deposited on said sleeve to said reference surface of said charged toner conveyer;

a receiving substrate interposed between said back electrode and said charged toner conveyer;

means for moving said receiving substrate at a speed, LSS, in a direction perpendicular to the first rotation axis;

a printhead structure interposed between said receiving substrate and said charged toner conveyer at a distance B from said charged toner conveyer, the printhead structure having an array of printing apertures and a control electrode, the array of printing apertures extending a distance C along the direction of movement of the receiving substrate;

wherein a ratio of the linear speed of the sleeve to the speed of the receiving substrate LSM/LSS≧0.50.

2. A direct electrostatic printing device according to claim 1, wherein said surface speed of said charged toner conveyer LSC and said speed of the receiving substrate LSS relate to each other in a ratio LSC/LSS≧0.50.

3. A direct electrostatic printing device according to claim 1, wherein said surface speed of said sleeve LSM and said surface speed of said charged toner conveyer LSC relate to each other in a ratio LSM/LSC≧0.50.

4. A direct electrostatic printing device according to claim 1, wherein the surface speed of the sleeve LSM and the speed of the receiving substrate LSS relate to each other in the ratio LSM/LSS≧1.50; said surface speed of said charged toner conveyer LSC and said speed of said receiving substrate LSS relate to each other in a ratio LSC/LSS≧1.00; and said surface speed of said sleeve LSM and said surface speed of said charged toner conveyer LSC relate to each other in a ratio LSM/LSC≧1.00.

5. A direct electrostatic printing device according to claim 1, wherein said charged toner conveyer has a surface roughness of at least 0.50 mm.

6. A direct electrostatic printing device according to claim 1, wherein said charged toner conveyer is cylindrical in a zone proximate to the printhead, the cylindrical zone having a radius of curvature R fulfilling the equation:

$$R \geq \frac{C^2}{4.25B + 0.25}$$

7. A direct electrostatic printing device according to claim 1, wherein said charged toner conveyer is cylindrical in a zone proximate to the printhead, the cylindrical zone having a radius of curvature R fulfilling the equation:

$$R \geq \frac{C^2}{1.55B + 0.25}$$

8. A direct electrostatic printing device according to claim 1, wherein said charged toner conveyer is cylindrical in a zone proximate to the printhead, the cylindrical zone having a radius of curvature R fulfilling the equation:

$$R \geq \frac{C^2}{0.30B + 0.25}$$

9. A direct electrostatic printing device according to 1, wherein said charged toner particles have an average charge |q|, in absolute value, fulfilling the equation 1 fC≦|q|≦20 fC.

10. A direct electrostatic printing device according to claim 1, further comprising an AC source connected to said sleeve of said magnetic brush.

11. A direct electrostatic printing device according to claim 1, comprising two magnetic brushes, each magnetic brush having a core and a sleeve rotatably mounted around said core.

12. A direct electrostatic printing device according to claim 11, wherein a first of said magnetic brushes is a pushing magnetic brush for jumping charged toner particles to said charged toner conveyer and a second of said magnetic brushes is a pulling magnetic brush for removing charged toner particles from said charged toner conveyer.

13. A direct electrostatic printing device according to claim 12, wherein said charged toner particles have a specified polarity, said sleeve of said pushing magnetic brush is connected to a DC power source with a polarity equal to the polarity of the charged toner particles, and said sleeve of said pulling magnetic brush is connected to a DC power source with a polarity opposite to the polarity of the charged toner particles.

* * * * *